US006105522A

United States Patent [19]

Kato

[11] Patent Number: 6,105,522

[45] Date of Patent: Aug. 22, 2000

[54] SHUTTLE HOOK DRIVER FOR SEWING MACHINE

[75] Inventor: Satoshi Kato, Kariya, Japan

[73] Assignee: Brother Kogyo Kabushiki Kaisha, Nagoya, Japan

[21] Appl. No.: 09/246,135

[22] Filed: Feb. 8, 1999

[30] Foreign Application Priority Data

Feb. 9, 1998 [JP] Japan ..... 10-044533

[51] Int. Cl.[7] ..... D05B 57/30

[52] U.S. Cl. ..... 112/220

[58] Field of Search ..... 112/220, 228–231, 112/189, 181–190; 77/63

[56] References Cited

U.S. PATENT DOCUMENTS 2,223,315 11/1940 Deihl et al. ..... 112/220
2,905,120 9/1959 Hacklander ..... 112/220 X
3,095,752 7/1963 Bono ..... 112/220 X
4,010,700 3/1977 Webb ..... 112/220 X
4,425,860 1/1984 Landwehr et al. ..... 112/220 X
5,205,230 4/1993 Jiminez et al. ..... 112/220
5,832,851 11/1998 Kato ..... 112/220 X

*Primary Examiner*—Ismael Izaguirre
*Attorney, Agent, or Firm*—Oliff & Berridge, PLC

[57] ABSTRACT

A shuttle hook driver for a sewing machine includes a stepping motor for driving a shuttle hook capturing a thread loop in cooperation with a sewing needle, the stepping motor including a drive shaft, the shuttle hook including a hook shaft, an elastic member provided on a connecting member connecting between an end of the drive shaft of the stepping motor and an end of shuttle hook so as to be capable of transmitting a driving force of the drive shaft to shuttle hook and of buffing, and a damping mechanism provided on the connecting member for damping rotation of each one of the hook shaft and the drive shaft relative to the other.

20 Claims, 10 Drawing Sheets

SHUTTLE HOOK DRIVER FOR SEWING MACHINE

BACKGROUND OF THE INVENTION

1. Field of the Invention

This invention relates generally to a shuttle hook driver for a sewing machine provided with a stepping motor for driving a shuttle hook, and more particularly to such a shuttle hook driver in which rotation of each of a drive shaft of the stepping motor and a hook shaft of the shuttle hook relative to the other is damped.

2. Description of the Related Art

Sewing machines have conventionally been provided with a shuttle hook driver for driving a thread loop capturing shuttle capturing a thread loop in cooperation with a sewing needle. In a main shaft-linked type, the shuttle driver is driven in synchronization with a main shaft of the sewing machine driven by a sewing machine motor. On the other hand, shuttle hook drivers of the independent drive type have recently been put to an actual use. In the independent drive type, a dedicated stepping motor is provided for driving the shuttle independent of the main shaft, so that the shuttle is driven in synchronization with the main shaft and so that the rotation of the shuttle is controlled according to the varying sewing conditions. In the shuttle hook driver of the independent drive type, the stepping motor is generally disposed in a sewing bed. An end of a drive shaft of the stepping motor is connected directly to an end of the hook shaft by suitable coupling means. When the drive shaft of the stepping motor and the shuttle hook are thus connected fixedly together, the stepping motor is subjected to an inertia force of the shuttle hook via the hook shaft and the drive shaft at the time of speed change, for example, at the time of start and stop of the stepping motor. When the inertia force is increased, there is a possibility of loss of synchronism in the stepping motor.

To solve the above-described problem, the inventor of the present application proposed a shuttle hook driver of the independent drive type in which an elastic member is provided on a connecting member connecting the ends of the drive shaft and the hook shaft together. The elastic member is capable of transmitting rotating force or torque of the drive shaft to the hook shaft and performing a buffing action. The elastic member is elastically deformed such that the inertia force of the shuttle hook at the time of speed change in the stepping motor is buffed or absorbed, thereby preventing loss of synchronism of the stepping motor.

In the proposed shuttle hook driver, the inertia force of the shuttle hook can be lessened or buffed by the elastic deformation of the elastic member. However, an elastic energy is stored in the deformed elastic member. A rotating force of the shuttle hook due to the stored elastic energy sometimes acts in the same direction as the inertia force of the shuttle hook when the rotation of the stepping motor is stopped and when the stepping motor is rotated in the reverse direction immediately after the stop of rotation thereof. The stepping motor is subjected to a large resultant force, thereby tending to cause loss of synchronism.

Moreover, since the inertia force of the shuttle hook is further increased when the shuttle hook is driven at high speeds, the elastic member is elastically deformed to a large degree and accordingly, the elastic energy stored in the elastic member is increased. This further increases the rotating force of the shuttle hook due to the elastic energy. When the stepping motor is subjected to a resultant force of the increased rotating force, the stepping motor further tends to be desynchronized. Thus, the proposed shuttle hook driver poses a problem preventing a high-speed operation of the sewing machine.

The loss of synchronism can be considered to be prevented by increasing the size of the stepping motor. However, since the stepping motor is disposed in the sewing bed, to increase the size of the stepping motor is actually difficult.

SUMMARY OF THE INVENTION

Therefore, an object of the present invention is to provide a shuttle hook driver for a sewing machine provided with a stepping motor for driving the shuttle hook, which shuttle hook driver can prevent loss of synchronism of the stepping motor and can accomplish a high-speed operation of the sewing machine.

The present invention provides a shuttle hook driver for a sewing machine comprising a stepping motor for driving a shuttle hook capturing a thread loop in cooperation with a sewing needle. The stepping motor includes a drive shaft and the shuttle hook includes a hook shaft. An elastic member is provided on a connecting member connecting between an end of the drive shaft of the stepping motor and an end of the shuttle hook so as to transmit a driving force of the drive shaft to the shuttle hook and so as to serve as a buffer. A damping mechanism is provided on the connecting member for damping rotation of each of the hook shaft and the drive shaft relative to each other.

Upon drive of the stepping motor, rotation of the drive shaft thereof is transmitted via the elastic member of the connecting member to the hook shaft so that the shuttle hook is driven. An inertia force of the shuttle hook is buffed by the elastic member at the time of speed change such as the time of start or stop of the stepping motor.

The above-mentioned buffing action is obtained by the elastic deformation of the elastic member accompanied with the rotation of each of the hook shaft and the drive shaft relative to the other. An elastic energy is stored in the deformed elastic member. A rotating force of the shuttle hook due to the stored elastic energy sometimes acts in the same direction as of the inertia force of the shuttle hook when the rotation of the stepping motor is stopped and when the stepping motor is rotated in the reverse direction immediately after the stop of rotation thereof. In such a case, however, the damping mechanism provided on the connecting member damps the relative rotation. Consequently, since an external force including the inertia force acting on the stepping motor and the rotating force is restrained, the stepping motor can be prevented from the loss of synchronism.

Accordingly, high-speed rotation of the shuttle hook or high-speed operation of the sewing machine including sudden start and stop can be accomplished without use of a large stepping motor or with use of such a small stepping motor as to be accommodated in the sewing bed. Further, since a small stepping motor is used, the shuttle hook driver can be rendered small-sized and is accordingly advantageous in the manufacturing cost.

In a preferred form, the connecting member includes a first semi-cylindrical member secured to the drive shaft of the stepping motor and a second semi-cylindrical member secured to the hook shaft and disposed opposite to the first semi-cylindrical member with the elastic member being positioned therebetween. Further, the damping mechanism includes a coil-shaped tensioning member wound closely on outer circumferences of the first and second semi-cylindrical members and secured to either the first or second semi-cylindrical member.

According to the above-described construction, the coil-shaped tensioning member is rotated with either one of the first and second semi-cylindrical members when the hook shaft and the drive shaft are rotated relative to each other. Consequently, the relative rotation can be damped by friction between the outer circumferential face of the other of the first and second semi-cylindrical members and the tensioning member.

In another preferred form, the damping mechanism includes a leaf spring secured to either one of the first and second semi-cylindrical members and a friction-inducing member urged so as to abut via the leaf spring an outer circumferential face of the other of the first and second semi-cylindrical members. In this construction, the damping mechanism preferably includes a notch formed in the covering member so as to be located at a side of either the first or second semi-cylindrical member and a leaf spring for radially inwardly urging opposed edge sides of the notch in the covering member. The opposed ends of the notch is subjected to the urging force of the leaf spring to thereby abut the outer circumferential face of either the first or second semi-cylindrical member. Consequently, friction can be induced in an abutment for damping the relative rotation.

The invention also provides a shuttle hook driver for a sewing machine comprising a stepping motor for driving a shuttle hook capturing a thread loop in cooperation with a sewing needle, the stepping motor including a drive shaft, the shuttle hook including a hook shaft, and a torque damping member provided on a connecting member connecting between an end of the drive shaft of the stepping motor and an end of the hook shaft of the shuttle hook so as to transmit a driving force of the drive shaft to shuttle hook and so as to serve as a buffer, the torque damping member damping rotation of either the hook shaft or the drive shaft relative to each other.

A rotary oil damper is preferably mounted on the drive shaft of the stepping motor. According to this construction, when a rotating force of the shuttle hook due to the elastic energy of the elastic member acts in the same direction as of the inertia force of the shuttle hook, the rotation of each of the hook shaft and the drive shaft relative to each other is damped by the rotary oil damper. Consequently, the external force including the inertia force acting on the stepping motor and the rotating force can be restrained.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENTS

Figure 1:
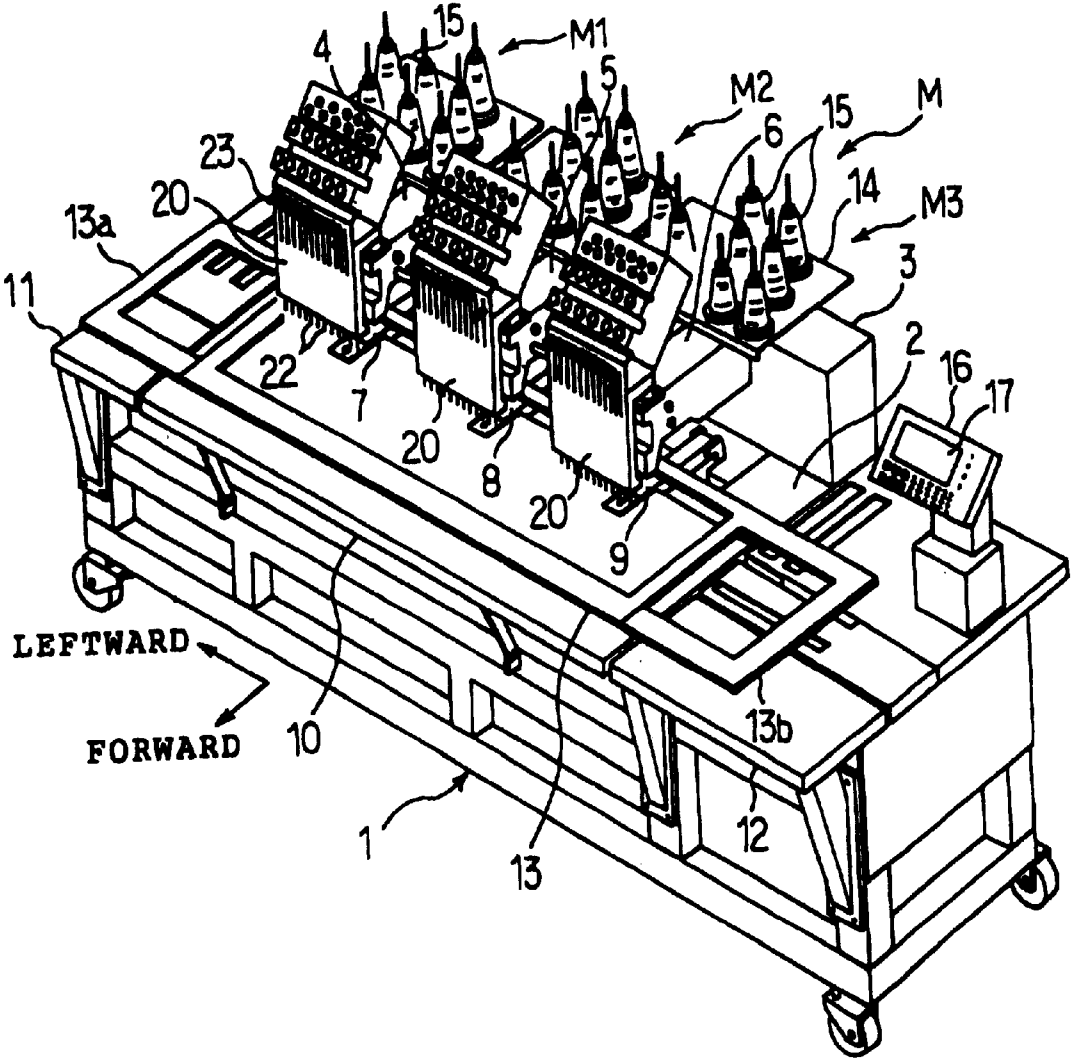
FIG. 1 is a perspective view of a multi-head embroidering machine including three multineedle embroidering machines to each of which the shuttle hook driver of a first embodiment in accordance with the present invention is applied.

A first embodiment of the present invention will be described with reference to FIGS. 1 to 7. The shuttle hook driver in accordance with the invention is applied to each of three multineedle embroidering machines of a multi-head embroidering machine capable of sewing three same embroidery patterns on three workpiece cloths respectively simultaneously. Referring to FIG. 1, the multi-head embroidering machine M is shown. The multi-head embroidering machine M comprises an elongated base frame 1 extending laterally and three multineedle embroidering machines M1, M2 and M3 provided on the base frame 1 to be arranged lengthwise with respect thereto. A rectangular machine support plate 2 is provided on the upper rear of the base frame 1. A laterally extending support frame 3 stands on the upper rear end of the machine support plate 2. Sewing arms 4 to 6 of the respective embroidering machines M1 to M3 extend forward from the support frame 3. Sewing beds 7 to 9 of the respective embroidering machines M1 to M3 extend forward from portions of the base frame 1 located at the front end of the machine support plate 2 so as to be opposed to the respective arms 4 to 6.

A working table 10 and a pair of auxiliary tables 11 and 12 are provided on the upper front of the base frame 1. The working table 1 is disposed substantially at the level of top faces of the beds 7 to 9 (bed faces). The auxiliary tables 11 and 12 are located at the left-hand and right-hand sides of the working table 10. A rectangular moving frame 13 is disposed to extend over the working and auxiliary table 10, 11 and 12. The moving frame 13 holds a piece of workpiece cloth in a stretched state. The moving frame 13 includes a left-hand drive frame **13*a* moved forward and rearward by a forward and rearward driving mechanism (not shown) and a right-hand drive frame 13*b* moved forward and rearward by the forward and rearward driving mechanism and leftward and rightward by a leftward and rightward driving mechanism (not shown), 60 that the overall moving frame 13** is moved forward, rearward, leftward and rightward.

Three spool holder bases 14 corresponding to the respective embroidering machines M1 to M3 are provided on the top of the support frame 3. Twelve spools 15 are set on each spool holder base 14. An operation panel 16 is provided on a rear portion of the auxiliary table 12. The operation panel 16 is provided with various keys including a sewing start key, a sewing stop key and numeric keys and a display for displaying messages regarding the embroidering.

The multineedle embroidering machines M1 to M3 will now be described with reference to FIGS. 1 to 7. Since the three embroidering machines M1 to M3 have the same construction, identical or similar parts are labeled by the same reference symbols. Each multineedle embroidering machine comprises twelve vertically directed needle bars 21 accommodated in a needle bar case 20 and arranged in a row right and left and twelve thread take-up levers 23 disposed over the respective needle bars 21 in a row right and left. Each multineedle embroidering machine also comprises a needle bar driving mechanism (not shown) for vertically driving one of the needle bars 21 assuming a sewable position and a thread take-up lever driving mechanism (not shown) for vertically driving the thread take-up lever 23 corresponding to the needle bar 21 assuming the sewable position. Each multineedle embroidering machine further comprises a needle bar switching mechanism (not shown) moving the needle bar case 20 right and left for selectively switching the needle bars 21 to the sewable position and a shuttle hook driver 30 for rotating or otherwise driving a shuttle hook 25 capturing a thread loop in cooperation with a sewing needle 22.

The needle bar driving mechanism and the thread take-up lever driving mechanism vertically moves the needle bar 21 and the thread take-up lever 23 both assuming the sewable position in synchronization with a main shaft driven by a sewing machine motor (not shown) respectively. The needle bar switching mechanism includes a switching motor (not shown) driven so that three needle bar cases 20 are moved together right and left, whereby thread colors are simultaneously changed. A thread cutting mechanism (not shown) is provided for cutting off, below a throat plate 27, a needle thread extending from the eye of the needle 22 fixed to a lower end of the needle bar 21 assuming the sewable position while the needle bar 21 is in upward movement from a lower position. Since these mechanisms are well known in the art, further description of the mechanisms will be eliminated.

Figure 2:
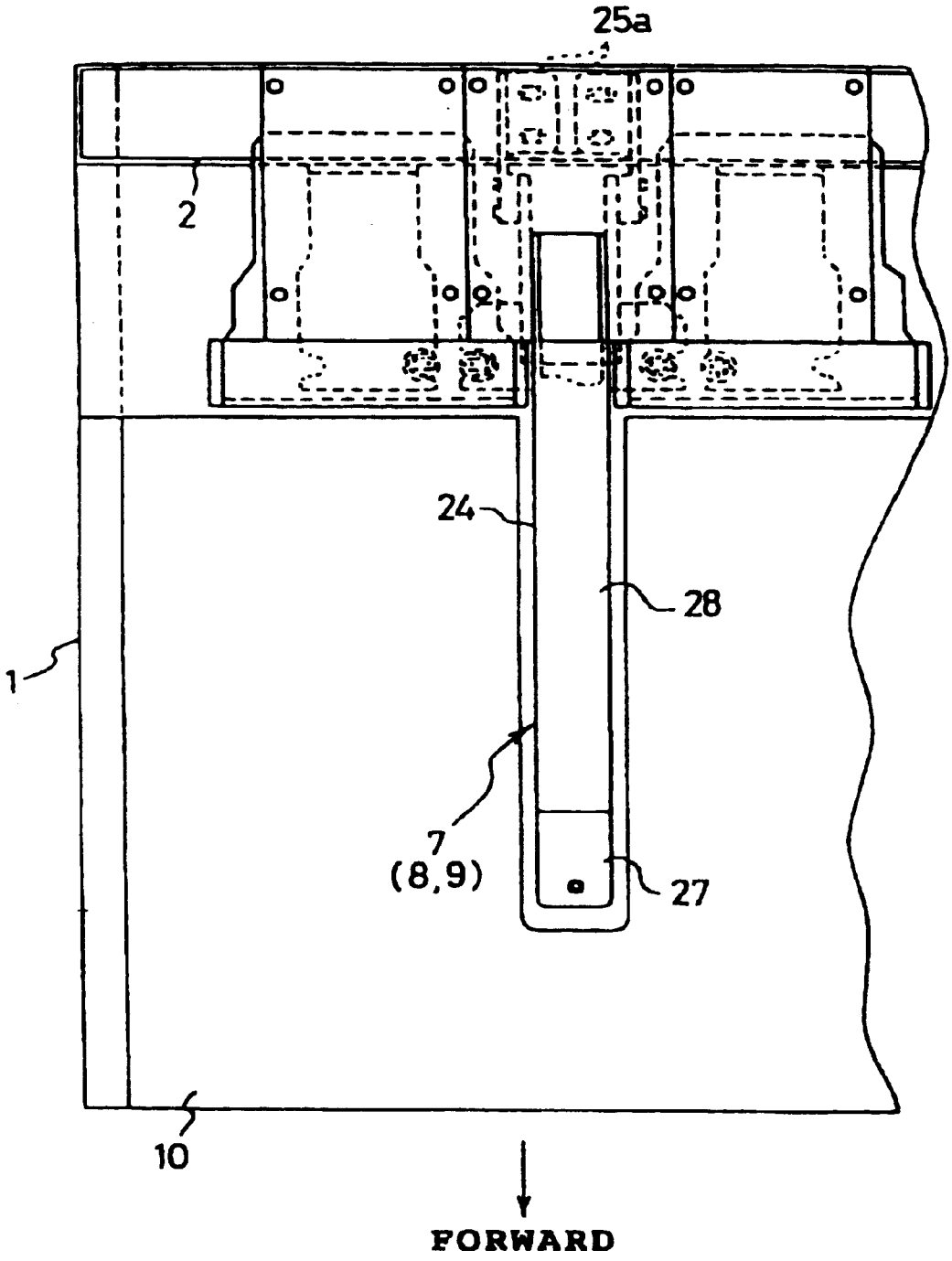
FIG. 2 is a partial plan view of the multineedle embroidering machine.
Figure 3:
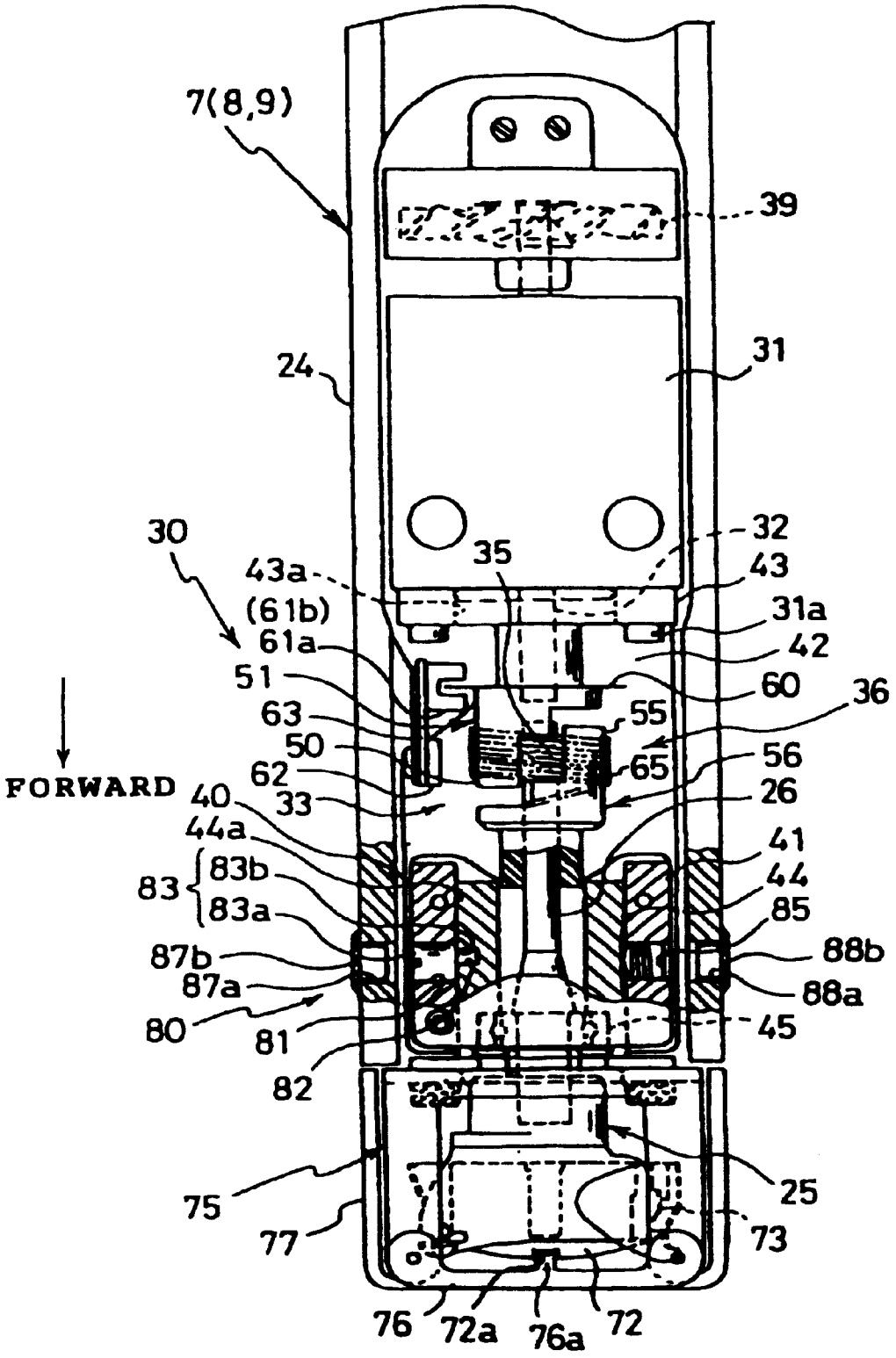
FIG. 3 is a plan view of the shuttle hook driver.
Figure 4:
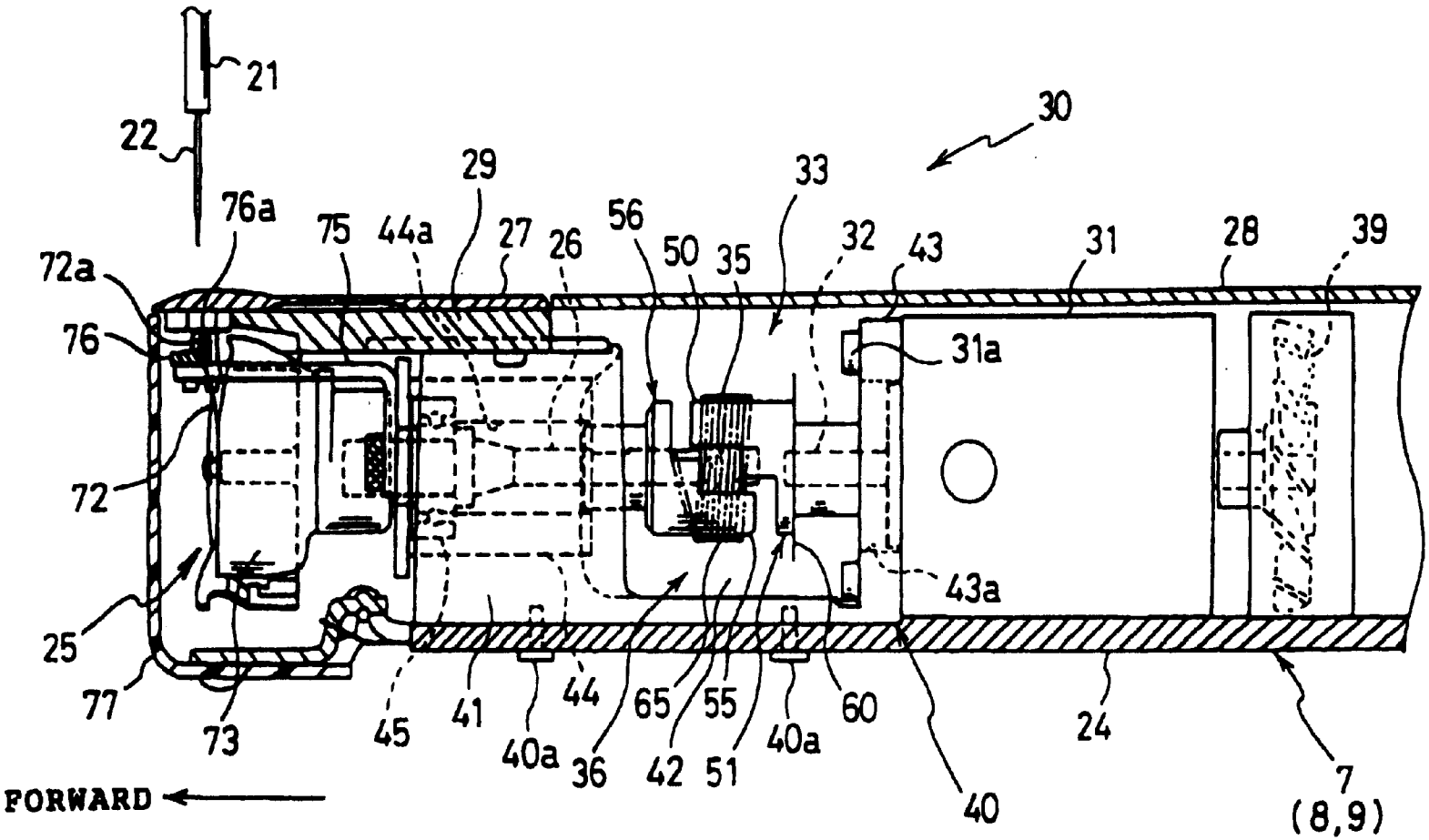
FIG. 4 is a side view of the shuttle hook driver.

Referring to FIGS. 2 to 4, the embroidering machines M1 to M3 comprise sewing beds 7 to 9 respectively. Each bed has a bed case 24 with a substantially U-shaped section. A rear end of each bed case 24 is secured to a pair of support brackets 25*a* further secured to the support plate 2. An upper side of the front end of each bed case 24 is covered by the throat plate 27. A cover plate 28 is provided adjacent to the throat plate 27 for covering the upper side of the bed case 24 located in the rear of the throat plate 27. The shuttle hook 25 and the shuttle hook driver 30 connected together are detachably provided in the front interior of each bed case 24.

Figure 5:
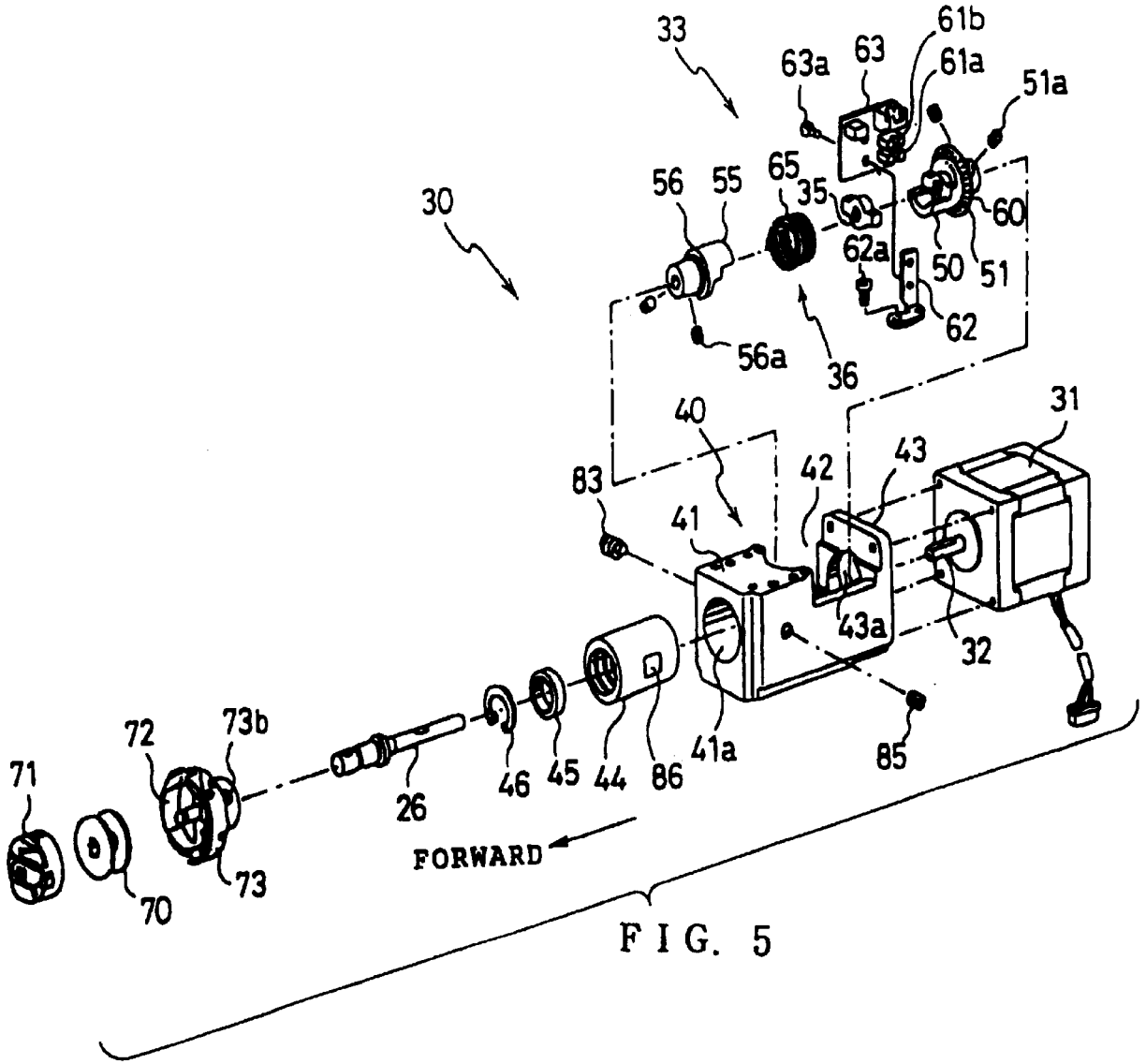
FIG. 5 is an exploded perspective view of a shuttle hook and the shuttle hook driver.
Figure 6:
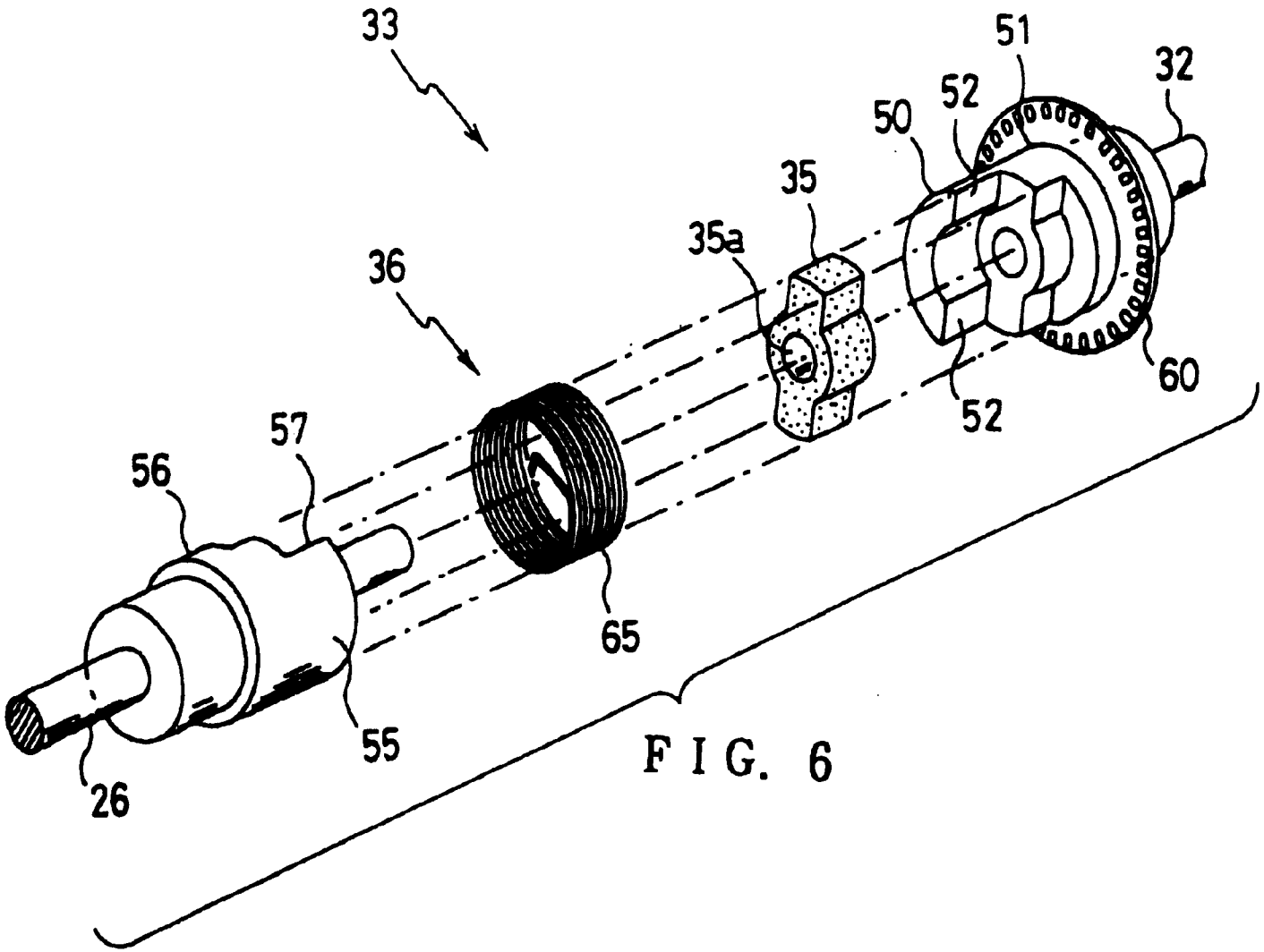
FIG. 6 is a partial exploded perspective view of the shuttle hook driver.
Figure 7:
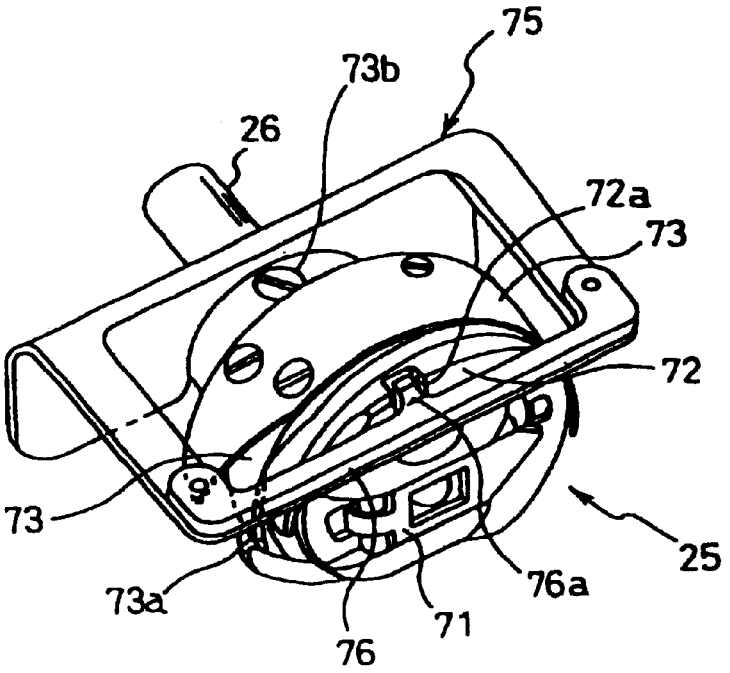
FIG. 7 is a perspective view of the shuttle hook.

The shuttle hookdriver 30 will now be described. Referring to FIGS. 3 to 5, the shuttle hook driver 30 includes a stepping motor 31 for driving the shuttle hook 25. A connecting member 33 is provided for connecting between a front end of a drive shaft 32 and a rear end of a hook shaft 26 of the shuttle hook 25. The connecting member 33 includes an elastic member 35 made of a hard rubber such as urethane and a damping mechanism 36 for damping rotation of each one of the hook shaft 26 and the drive shaft 32 relative to the other by means of friction. The elastic member 35 is capable of both transmitting a rotating force of the drive shaft 32 to the hook shaft 26 and buffing.

An attachment block 40 including a block section 41, an accommodating section 42 and a rear wall 43 is detachably fixed to the front end of the bed case 24 by a plurality of small screws 40*a*. A front end of the stepping motor 31 is fixed to a rear end of the rear wall 43 of the attachment block 40 by a plurality of small screws 31*a*. The drive shaft 32 of the stepping motor 31 extends forward through a hole 43*a* formed in the rear wall 43 into the accommodating section 42. The drive shaft 31 also extends rearward, and a cooling fan 39 is secured to the rearwardly extending portion thereof.

The block section 41 of the attachment block 40 has an insertion hole 41*a* extending lengthwise with respect to the bed case 24. A sleeve 44 is fitted in the hole 41*a* so as to be movable forward and rearward. A bearing 45 is force-fitted into the front of the sleeve 44 and prevented from falling off by a fall-off preventing member 46. The hook shaft 26 extends through the sleeve 44 to be supported via the bearing 45 so as to be rotatable and immovable forward and rearward. A rear portion of a base member 29 is secured to an upper face of the block section 41. The throat plate 27 is mounted on an upper side of the base member 29.

Referring to FIGS. 3 to 6, the connecting member 33 includes a first substantially semi-cylindrical member 50 secured to the drive shaft 32 and a second substantially semi-cylindrical member 55 provided opposite to the first semi-cylindrical member 50 with the elastic member 35 being interposed therebetween and secured to the hook shaft 26. A connecting member 51 is fitted with the front end of the drive shaft 32 of the stepping motor 31 and fixed thereto by a pair of small screws 56*a*. The connecting member 51 includes a front end portion serving as the first semi-cylindrical member 50. Another connecting member 56 is fitted with the rear end of the hook shaft 26 and fixed thereto by a pair of small screws 56*a*. The connecting member 56 includes a front end portion serving as the second semi-cylindrical member 55. The rear end of the hook shaft 26 is caused to pass through an insertion hole 35*a* of the elastic member 35 and slidably fitted into the connecting member 51 secured to the drive shaft 32.

The first semi-cylindrical member 50 includes both circumferential end faces serving as coplanar abutment faces 52 respectively. The second semi-cylindrical member 55 includes both circumferential end faces serving as coplanar abutment faces 57 respectively. These abutment faces 52 and 57 are disposed to be opposite to each other and abut the elastic member 35 to thereby transmit the rotating force of the drive shaft 32 via the elastic member 35 to the hook shaft 26. Further, a buffing action is obtained from the elasticity of the elastic member 35 when the rotating force of the drive shaft 32 is transmitted to the hook shaft 26. A disc encoder 60 is mounted on the connecting member 51 secured to the drive shaft 32 of the stepping motor 31. Each of optical sensors 61*a* and 61*b* comprises light-emitting and light-receiving sections between which the disc encoder 60 is interposed. An original or initial position and a rotational position of the stepping motor 31 are detected by the above-described optical sensors 61*a* and 61*b*. A vertical bar 62 is secured to the bottom of the bed case 24 by a small screw 62*a*. A vertical mounting plate 63 is secured to the vertical bar 62 by a small screw 63*a*. The optical sensors 61*a* and 61*b* are mounted on the mounting plate 63.

The damping mechanism 36 includes a coil-shaped tensioning member wound closely on outer circumferences of the first and second semi-cylindrical members 50 and 55 and secured to the first semi-cylindrical member 50 side by an adhesive agent containing epoxy resin. The tensioning member 65 comprises a metal wire, for example. The metal wire is wound on the outer circumferences of the first and second semi-cylindrical members 50 and 55 about ten turns. When each of the hook shaft 26 and the drive shaft 32 is rotated relative to the other, the first semi-cylindrical member 50 and the tensioning member 65 are rotated together, so that friction is induced between the outer circumferential face of the second semi-cylindrical member 55 and the tensioning member 65. The friction damps the relative rotation between the hook shaft 26 and the drive shaft 32.

The coil-shaped tensioning member 65 may be secured to the second semi-cylindrical member 55, instead of the first semi-cylindrical member 50. In this case, when each of the hook shaft 26 and the drive shaft 32 is rotated relative to the other, the second semi-cylindrical member 55 and the tensioning member 65 are rotated together, so that friction is induced between the outer circumferential face of the first semi-cylindrical member 50 and the tensioning member 65. The friction damps the relative rotation between the hook shaft 26 and the drive shaft 32. Further, means for securing the coil-shaped tensioning member 65 to either the first or second semi-cylindrical member 50 or 55 may be laser welding instead of the adhesive agent of epoxy resin.

The shuttle hook 25 will now be described with reference to FIGS. 3 to 5 and 7. The shuttle hook 25 comprises a rotating hook bobbin case holder 72 holding a bobbin case 71 accommodating a looper thread bobbin 70 and a rotating hook 73 rotating outside the holder 72. The rotating hook 73 is fitted with a distal end of the hook shaft 26 and secured thereto by a plurality of small screws 73*b*. The rotating hook 73 has a point-of-hook 73*a* hooking a needle thread extending from the eye hole of the needle 22 to form a needle thread loop. When the main shaft is at the rotation position of about 190 degrees, the point-of-hook 73*a* meets the eye hole of the needle 22 and hooks the needle thread, forming the needle thread loop moved between the rotating hook bobbin case holder 72 and the rotating hook 73 by the rotation of the latter. Thereafter, the thread is tightened up by the thread take-up lever 23 so that the bobbin thread extending from the bobbin 70 and the needle thread are entangled, whereby stitches are formed.

A frame-shaped shuttle holder 75 encircling the upper end of the shuttle hook 25 is fixed to a front end of the sleeve 44. The holder 75 includes a shuttle holding member 76 disposed on a front end thereof. The shuttle holding member 76 is formed with a rearwardly protruding engagement protrusion 76*a*. The protrusion 76*a* loosely engages a recess 72*a* formed in the upper end of the bobbin case holder 72, so that the rotation of the bobbin case holder 72 is limited. A cover 77 is detachably mounted on the front end of the bed case 24 to cover the front side of the shuttle hook 25.

The shuttle hook driver 30 is provided with a shuttle hook position adjusting mechanism 80 for adjusting a front-to-back position of the shuttle hook 25. Referring to FIGS. 3 and 5, the block section 41 of the mounting block 40 is formed with a pin hole 81 through which an eccentric pin 83 is inserted from the left-hand side. The sleeve 44 has a vertically elongate pin groove 82 formed in the outer circumference thereof so as to correspond to the pin hole 81. The eccentric pin 83 has a thread groove in an outer end thereof and includes a support shaft portion 83*a* and an eccentric shaft portion 83*b*. The support shaft portion 83*a* of the pin 83 is force-fitted into the pin hole 81 for rotation, whereas the eccentric shaft portion 83*b* thereof slidably engages the pin groove 82 of the sleeve 44. As a result of the construction, the shuttle hook 25 is moved forward and rearward together with the sleeve 44 and the hook shaft 26 in the range of a short stroke (about 2 to 4 mm) which is twice as large as a distance (about 1 to 2 mm) between shaft centers of the support shaft portion 83*a* and the eccentric shaft portions 83*b*, whereby the front-to-back position of the shuttle hook 25 is adjusted.

A set vis or small screw 85 is screwed into the block portion of the mounting block 40 from the right-hand side. The set screw 85 is fastened up so that a distal end thereof presses against a pressed face 86 of the sleeve 44, whereby the sleeve 44 can be fixed to the block portion so as to be disallowed to move forward and rearward. On the other hand, when the set screw 85 is loosened, the sleeve 44 is allowed to move forward and rearward. The connecting member 33 can allow the hook shaft 26 to move forward and rearward relative to the drive shaft 32. The bobbin holder 75 is moved forward and rearward together with the shuttle hook 25. The bed case 24 has tool insertion holes 87*a* and 88*a* formed in the opposite sides thereof. Tools are inserted into the tool insertion holes 87*a* and 88*a* for rotating the eccentric pin 83 and the set screw 85. The tool insertion holes 87*a* and 88*a* are usually closed by cap members 87*b* and 88*b* respectively.

The operation of the shuttle hook driver 30 will be described. Upon drive of the stepping motor 31, the rotating force of the drive shaft 32 is transmitted via the elastic member 35 of the connecting member 33 to the hook shaft 26 so that the hook shaft 25 (the rotating hook 73) is rotated or otherwise driven together with the hook shaft 26. A frictional force applied to the hook shaft 25 is transmitted to the hook shaft 26 at the time of speed change, for example, at the time of start and stop of the stepping motor 31. The elastic member 35 of the connecting member 33 causes a buffing action when the frictional force is transmitted to the drive shaft 32 side.

On the other hand, since the elastic member 35 is elastically deformed during the buffing action of the elastic member 35, an elastic energy is stored in the elastic member. In the construction that the connecting member is composed of only the elastic member as in the prior art construction, the rotating force of the shuttle hook 25 due to the elastic energy stored in the elastic member acts in the same direction as of the inertia force of the shuttle hook 25 when the rotation of the stepping motor 31 is stopped and when the stepping motor 31 is rotated in the reverse direction immediately after the stop of rotation thereof. A large resultant force acts via the drive shaft 32 on the stepping motor 31 such that the stepping motor 31 tends to be desynchronized to a large degree.

In the above-described shuttle hook driver 30, however, the damping mechanism 36 is provided in the connecting member 33 to damp the rotation of each of the hook shaft 26 and the drive shaft 32 relative to the other by means of friction. Consequently, since an external force including the inertia force acting on the stepping motor 31 and the rotating force is restrained, the stepping motor can be prevented from the loss of synchronism.

Accordingly, high-speed rotation of the shuttle hook 25 or high-speed operation of the sewing machine including sudden start and stop can be accomplished without use of a large stepping motor or with use of the small stepping motor 31 accommodated in the bed case 24 of each sewing bed 7–9. Further, since the small stepping motor 31 is used, the shuttle hook driver 30 can be rendered small-sized and is accordingly advantageous in the manufacturing cost.

Further, the connecting member 33 includes the first semi-cylindrical member 50 at the drive shaft 32 side and the second semi-cylindrical member 55 at the hook shaft 26 side, the semi-cylindrical members 50 and 55 being opposed to each other with the elastic member 35 being interposed therebetween. The damping mechanism 36 includes the coil-shaped tensioning member 65 wound closely on the outer circumferences of the first and second semi-cylindrical members 50 and 55 and secured to the first semi-cylindrical member side. Consequently, the structure of the connecting member 33 including the damping mechanism 36 cain be simplified, and moreover, the rotation of each of the hook shaft 26 and the drive shaft 32 relative to the other can reliably damped by the friction induced between the outer circumferential face of the second semi-cylindrical member 55 and the tensioning member 65.

Figure 8:
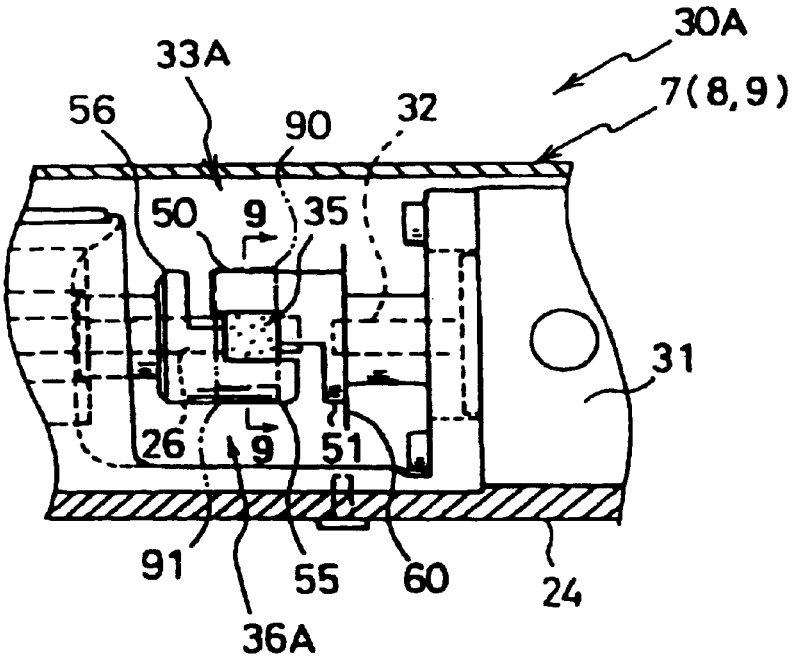
FIG. 8 is a partially sectional side view of the shuttle hook driver of a second embodiment in accordance with the invention.
Figure 9:
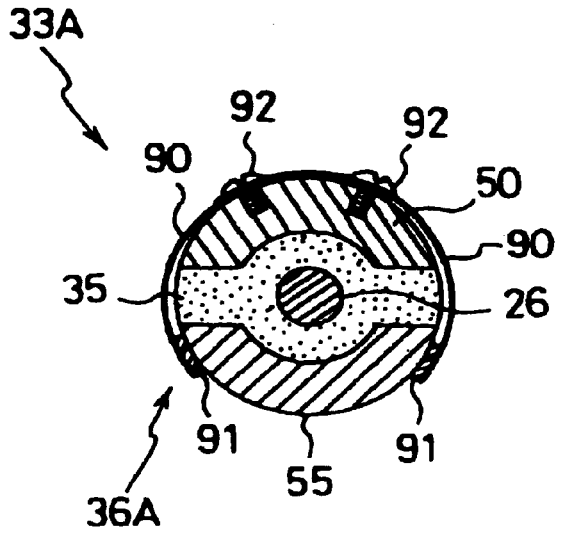
FIG. 9 is a view taken along line 9—9 in FIG. 8.

FIGS. 8 and 9 illustrate a second embodiment of the invention. The identical or similar parts in the second embodiment are labeled by the same reference symbols as in the first embodiment, and the description of these parts is eliminated. Only the difference between the first and second embodiments will be described. The shuttle hook driver 30A of the second embodiment includes a damping mechanism 36A provided in the connecting member 33A and comprising a pair of leaf springs 90 secured to the first semi-cylindrical member 50 and a pair of friction-inducing members 91 urged by the leaf springs 90 so as to abut the outer circumferential face of the second semi-cylindrical member 55, instead of the damping mechanism 36 provided with the coil-shaped tensioning member 65.

The paired leaf springs 90 are curved according to configurations of the first and second semi-cylindrical members 50 and 55. The leaf springs 90 are fixed by small screws 92 to the first semi-cylindrical member 50 so that one ends of the respective leaf springs are overlapped at the circumferential center of the first semi-cylindrical member. The other ends of the respective leaf springs 90 reach the outer circumferential face of the second semi-cylindrical member 55. The friction-inducing members 91 are secured to inside surfaces of said other ends of the first and second semi-cylindrical members 50 and 55 respectively. Each friction-inducing member 91 is made of a synthetic resin having sufficient durability and heat resistance, for example, POM, and urged by the corresponding leaf spring 90 to abut the outer circumferential face of the second semi-cylindrical member 55. Alternatively, the leaf springs 90 may be secured to the second semi-cylindrical member 55, and the friction-inducing members 91 urged by the respective leaf springs 90 may abut the outer circumferential face of the first semi-cylindrical member 50, instead.

According to the shuttle hook driver 30A, the structure of the connecting member 33A including the damping mechanism 36A can be simplified, and moreover, the rotation of each of the hook shaft 26 and the drive shaft 32 relative to the other can reliably be damped by the friction induced between the friction-inducing member 91 and the outer circumferential face of the second semi-cylindrical member 55.

Figure 10:
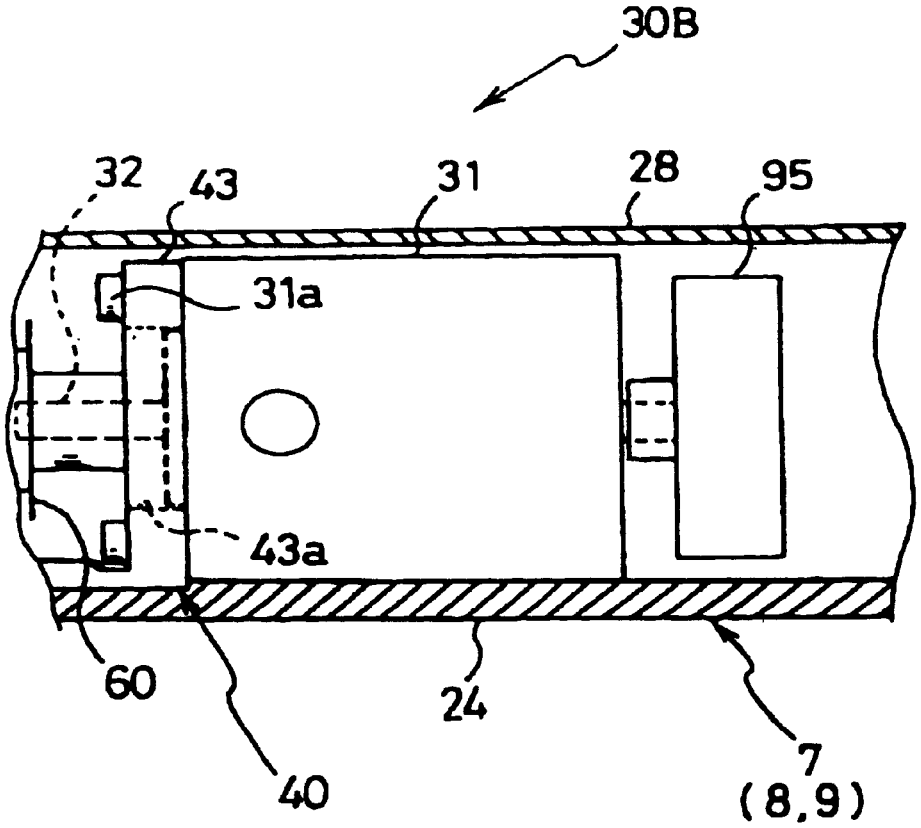
FIG. 10 is a partially sectional side view of the shuttle hook driver of a third embodiment in accordance with the invention.

FIG. 10 illustrates a third embodiment of the invention. The identical or similar parts in the third embodiment are labeled by the same reference symbols as in the first embodiment, and the description of these parts is eliminated. Only the difference between the first and third embodiments will be described. In the shuttle hook driver 30B of the third embodiment, a rotary oil damper 95 serving as the damping mechanism is mounted on the drive shaft 32 of the stepping motor 31, instead of the damping mechanism 36. The drive shaft 32 of the stepping motor 31 extends rearward or to the side opposite the connecting member 33 as well as forward. The rotary oil damper 95 is mounted on the rearwardly extending end of the drive shaft 32. The rotary oil damper 95 may be mounted on another part of the drive shaft 32. The cooling fan 39 can be mounted on the drive shaft 32 as in the foregoing embodiments.

According to the above-described shuttle hook driver 30B, the rotation of each of the hook shaft 26 and the drive shaft 32 relative to the other is damped by the rotary oil damper 95 even when the rotating force of the shuttle hook 25 due to the elastic energy of the elastic member 35 acts in the same direction as the inertia force of the shuttle hook. Consequently, since the external force including the inertia force and the rotating force acting on the stepping motor 31 is restrained, the stepping motor can be prevented from the loss of synchronism.

Figure 11:
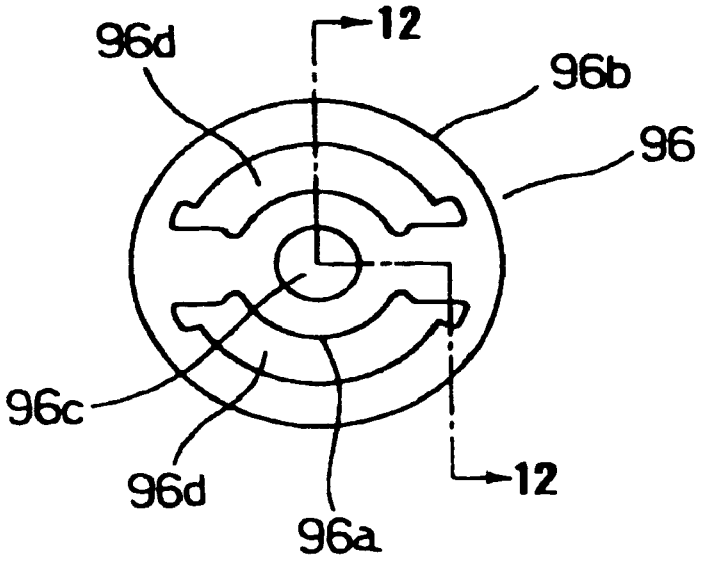
FIG. 11 is a front view of a torque damping member used in the shuttle hook driver of a fourth embodiment in accordance with the invention.
Figure 12:
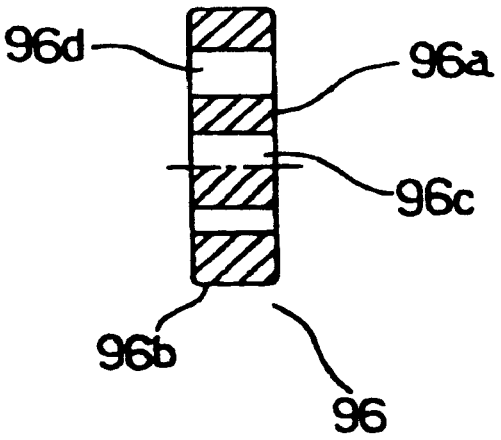
FIG. 12 is a view taken along line 12—12 in FIG. 11.

FIGS. 11 and 12 illustrate a fourth embodiment of the invention. The identical or similar parts in the fourth embodiment are labeled by the same reference symbols as in the first embodiment, and the description of these parts is eliminated. Only the difference between the first and fourth embodiments will be described. In the fourth embodiment, a torque damping member 96 is employed instead of the damping mechanism 36 including the elastic member 35 and the coil-shaped tensioning member 65. The torque damping member 96 includes a buffing portion 96*a* formed into substantially the same shape as the elastic member 35 and an covering member 96*b* serving as the damping mechanism, as shown in FIGS. 11 and 12. The covering member 96*b* is formed into such a shape as to circumferentially cover the overall outer circumferential faces of the first and second semi-cylindrical members 50 and 55. The buffing portion 96*a* and the covering member 96*b* are integrally formed of a hard rubber such as urethane as the elastic member 35. The buffing portion 96*a* has an insertion hole 96*c* into which the rear end of the hook shaft 96 is inserted. The first and second semi-cylindrical members 50 and 55 are fitted into fitting spaces or portions 96*d* defined by the buffing portion 96*a* and the covering member 96*b* respectively, thereby being connected together.

The operation of the shuttle hook driver of the fourth embodiment will be described. Upon drive of the stepping motor 31, the rotating force of the drive shaft 32 is transmitted via the torque damping member 96 to the hook shaft 26. The inertia force acting on the shuttle hook 25 and transmitted to the hook shaft 26 at the time of speed change, for example, at the time of start and stop of the stepping motor 31. The buffing portion 96*a* of the torque damping member 96 causes a buffing action when the inertia force is transmitted to the drive shaft 32 side. In this case, the rotation of each of the hook shaft 26 and the drive shaft 32 relative to the other is damped by the friction caused between the fitting portions 96*d* and the first and second semi-cylindrical members 50 and 55 fitted in the fitting portions respectively even when the rotating force of the shuttle hook 25 due to the elastic energy stored in the buffing portion 96*d* acts in the same direction as the inertia force of the shuttle hook.

According to the fourth embodiment, the torque damping member 96 which is a single component provides both buffing action and damping action for power transmitted between the stepping motor 31 and the shuttle hook 25. Consequently, the number of parts can be reduced. Further, the tensioning members 65 need to be bonded in the first embodiment, and the leaf springs 90 need to be screwed in the second embodiment. Since neither tensioning members nor leaf springs are required in the fourth embodiment, the shuttle hook driver can readily be assembled.

Figure 13:
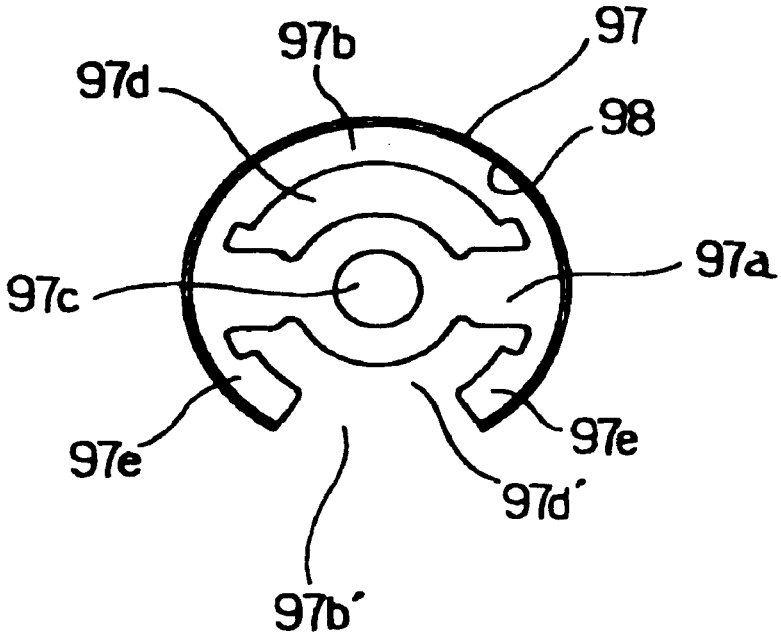
FIG. 13 is a view similar to FIG. 11, showing a fifth embodiment in accordance with the invention.

FIG. 13 illustrates a fifth embodiment of the invention. The identical or similar parts in the fifth embodiment are labeled by the same reference symbols as in the fourth embodiment, and the description of these parts is eliminated. Only the difference between the fourth and fifth embodiments will be described. In the fifth embodiment, the covering member 97*b* of the torque damping member 97 is formed by cutting out or notching a part of one side of the covering member 96*b* in the fourth embodiment, so that a notch 97*b'* is formed. The covering member 97*b* has a fitting portion 97*d* provided at the side without the notch 97*b'* and a fitting portion 97*d'* provided at the side of the notch 97*b'*. An arc-shaped leaf spring 98 is disposed along the outer circumferential face of the covering member 97*b*. The leaf spring 98 urges opposed ends 97*e* of the notched portion of the covering member 97*b* radially inward.

The operation of the shuttle hook driver of the fifth embodiment will be described. For example, assume that the first semi-cylindrical member 50 is fitted in the fitting portion 97*d*, whereas the second semi-cylindrical member 55 is fitted in the fitting portion 97*d'*. Of course, the second semi-cylindrical member 55 may be fitted in the fitting portion 97*d*, whereas the first semi-cylindrical member 50 may be fitted in the fitting portion 97*d'*. Upon drive of the stepping motor 31, the rotating force of the drive shaft 32 is transmitted via the torque damping member 97 to the hook shaft 26. The inertia force is transmitted to the hook shaft 26 at the time of speed change, for example, at the time of start and stop of the stepping motor 31. The buffing portion 97*a* of the torque damping member 97 causes a buffing action when the inertia force is transmitted to the drive shaft 32 side. In this case, the rotation of each of the hook shaft 26 and the drive shaft 32 relative to the other is damped by the friction caused mainly between the outer circumferential face of the second semi-cylindrical member 55 fitted in the fitting portion 97*d* and both ends 97*e* of the covering member 97*b*. The damping action is also caused between the fitting portion 97*d* and the first semi-cylindrical member 50.

According to the fifth embodiment, the torque damping member 97 and the leaf spring 98 provide the buffing action and the damping action for power transmitted between the stepping motor 31 and the shuttle hook 25. In this case, the frictional force caused between the outer circumferential face of the second semi-cylindrical member 55 and the ends 97*e* of the covering member 97*b* can be set or adjusted by setting or adjusting the urging force the leaf spring applies to the ends 97*e*. Consequently, dimensional tolerances of the first and second semi-cylindrical members 50 and 55 and the torque damping member 97 providing a proper damping action can be rendered larger as compared with the fourth embodiment in which the covering member 96*b* circumferentially covers the overall outer circumferential faces of the first and second semi-cylindrical members 50 and 55. Further, since the torque damping member 97 is made of urethane, it can be formed integrally with the leaf spring 98, whereupon the manufacturing step can be simplified.

Figure 14:
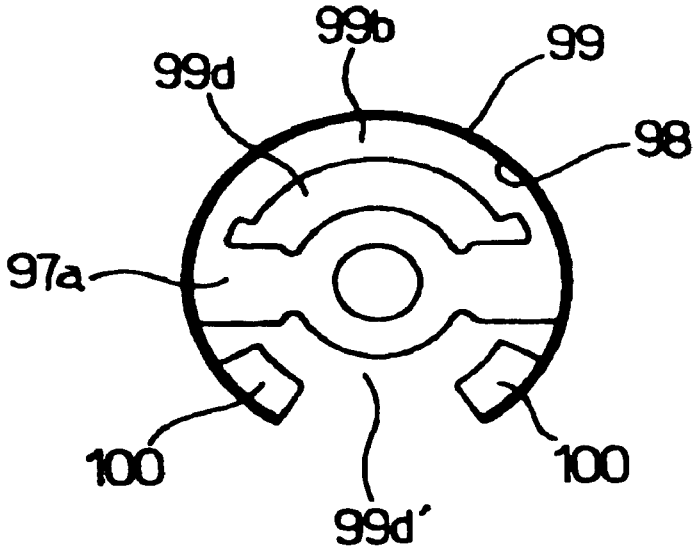
FIG. 14 is also a view similar to FIG. 11, showing a sixth embodiment in accordance with the invention.

FIG. 14 illustrates a sixth embodiment of the invention. The identical or similar parts in the sixth embodiment are labeled by the same reference symbols as in the fifth embodiment, and the description of these parts is eliminated. Only the difference between the fifth and sixth embodiments will be described. In the sixth embodiment, the torque damping member 99 includes only one covering member 99*b* provided at one side thereof or on a half part of the circumference thereof. The leaf spring 98 is disposed around the outer circumference of the covering member 99*b*. The friction-inducing members 100 are secured to the inside surfaces of both ends of the leaf spring 98 respectively. Each friction-inducing member 100 is made of a synthetic resin having sufficient durability and heat resistance, for example, POM, and urged by the leaf springs 98 radially inward. Further, the fitting portion 99*d* is defined by the buffing portion 99*a* and the covering member 99*b*. The other fitting portion 99*d'* is defined between the buffing portion 99*a* and the friction-inducing members 100 supported by the leaf spring 100.

The operation of the shuttle hook driver of the sixth embodiment will be described. For example, assume that the first semi-cylindrical member 50 is fitted in the fitting portion 99*d*, whereas the second semi-cylindrical member 55 is fitted in the fitting portion 99*d'*. Of course, the second semi-cylindrical member 55 may be fitted in the fitting portion 99*d*, whereas the first semi-cylindrical member 50 may be fitted in the fitting portion 99*d'*. Upon drive of the stepping motor 31, the rotating force of the drive shaft 32 is transmitted via the torque damping member 97 to the hook shaft 26. The inertia force is transmitted to the hook shaft 26 at the time of speed change, for example, at the time of start and stop of the stepping motor 31. The buffing portion 99*a* of the torque damping member 99 causes a buffing action when the inertia force is transmitted to the drive shaft 32 side. In this case, the rotation of each of the hook shaft 26 and the drive shaft 32 relative to the other is damped by the friction caused mainly between the outer circumferential face of the second semi-cylindrical member 55 fitted in the fitting portion 99*d'* and the friction-inducing members 100. The damping action is also caused between the fitting portion 99*d* and the first semi-cylindrical member 50.

According to the sixth embodiment, the torque damping member 99 and the leaf spring 98 provide the buffing action and the damping action for power transmitted between the stepping motor 31 and the shuttle hook 25. Accordingly, substantially the same effect can be achieved from the sixth embodiment as from the fifth embodiment.

The shuttle hook driver of the present invention should not be limited to the embodiments described with reference to the accompanying drawings. For example, the material for the elastic member and the torque damping member should not be limited to urethane. These members may be made of another material in the system of urethane, for example, polyurethane. Further, these members may be made of a hard rubber other than the system of urethane. Additionally, the invention may be applied to various types of sewing machines.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A shuttle hook driver for a sewing machine comprising:

a stepping motor for driving a shuttle hook capturing a thread loop in cooperation with a sewing needle, the stepping motor including a drive shaft, the shuttle hook including a hook shaft;

an elastic member provided on a connecting member connecting between an end of the drive shaft of the stepping motor and an end of the shuttle hook so as to transmit a driving force of the drive shaft to the shuttle hook and so as to serve as a buffer; and a damping mechanism provided on the connecting member for damping rotation of each one of the hook shaft and the drive shaft relative to the other.

2. A shuttle hook driver according to claim 1, wherein the elastic member is made of a hard rubber.

3. A shuttle hook driver according to claim 1, wherein the damping mechanism includes a rotary oil damper mounted on the drive shaft of the stepping motor.

4. A shuttle hook driver according to claim 3, wherein the rotary oil damper is mounted on a side of the drive shaft opposite a side thereof on which the connecting member is provided.

5. A shuttle hook driver according to claim 1, wherein the damping mechanism damps the rotation of each of the hook shaft and the drive shaft relative to the other by means of friction.

6. A shuttle hook driver according to claim 5, wherein the connecting member includes a first semi-cylindrical member secured to the drive shaft of the stepping motor and a second semi-cylindrical member secured to the hook shaft and disposed opposite to the first semi-cylindrical member with the elastic member being positioned therebetween, and the damping mechanism includes a coil-shaped tensioning member wound closely on outer circumferences of the first and second semi-cylindrical members and secured to either the first or second semi-cylindrical member.

7. A shuttle hook driver according to claim 5, wherein the connecting member includes a first semi-cylindrical member secured to the drive shaft of the stepping motor and a second semi-cylindrical member secured to the hook shaft and disposed opposite to the first semi-cylindrical member with the elastic member being positioned therebetween, and the damping mechanism includes a leaf spring secured to either one of the first and second semi-cylindrical members and a friction-inducing member urged so as to abut via the leaf spring an outer circumferential face of the other of the first and second semi-cylindrical members.

8. A shuttle hook driver according to claim 5, wherein the connecting member includes a first semi-cylindrical member secured to the drive shaft of the stepping motor and a seconds semi-cylindrical member secured to the hook shaft and disposed opposite to the first semi-cylindrical member with the elastic member being positioned therebetween, and the damping mechanism includes a covering member formed integrally with the elastic member and covering outer circumferential faces of the first and second semi-cylindrical members in contact with said faces.

9. A shuttle hook driver according to claim 8, wherein the covering member circumferentially covers the overall outer circumferential faces of the first and second semi-cylindrical members.

10. A shuttle hook driver according to claim 8, wherein the damping mechanism includes a notch formed in the covering member so as to be located at a side of either the first or second semi-cylindrical member and a leaf spring for radially inwardly urging opposed edge sides of the notch in the covering member.

11. A shuttle hook driver according to claim 5, wherein the connecting member includes a first semi-cylindrical member secured to the drive shaft of the stepping motor and a second semi-cylindrical member secured to the hook shaft and disposed opposite to the first semi-cylindrical member with the elastic member being positioned therebetween, and the damping mechanism includes a covering member formed integrally with the elastic member and covering outer circumferential faces of the first and second semi-cylindrical members in contact with said face of either one of the first and second semi-cylindrical members, an arc-shaped leaf spring disposed along the outer circumference of the covering member and having opposed ends extending to the other of the first and second semi-cylindrical members, and a pair of friction-inducing members disposed at both ends of the arc-shaped leaf spring so as to be urged by the leaf spring to abut the outer circumferential face of the other of the first and second semi-cylindrical members.

12. A shuttle hook driver for a sewing machine comprising:

a stepping motor for driving a shuttle hook capturing a thread loop in cooperation with a sewing needle, the stepping motor including a drive shaft, the shuttle hook including a hook shaft; and a torque damping member provided on a connecting member connecting between an end of the drive shaft of the stepping motor and an end of the hook shaft of the shuttle hook so as to transmit a driving force of the drive shaft to shuttle hook and so as to serve as a buffer, the torque damping member damping rotation of either the hook shaft or the drive shaft relative to each other.

13. A shuttle hook driver according to claim 12, wherein the torque damping member is made of a hard rubber.

14. A shuttle hook driver according to claim 12, wherein the connecting member includes a first semi-cylindrical member secured to the drive shaft of the stepping motor and a second semi-cylindrical member secured to the hook shaft and disposed opposite to the first semi-cylindrical member, and the torque damping mechanism includes a buffing member interposed between portions of the first and second semi-cylindrical members opposed to each other and a covering member covering outer circumferential faces of the first and second semi-cylindrical members in contact with said faces.

15. A shuttle hook driver according to claim 14, wherein the covering member circumferentially covers the overall outer circumferential faces of the first and second semi-cylindrical members.

16. A shuttle hook driver according to claim 14, wherein the torque damping member includes a notch formed in the covering member so as to be located at a side of either the first or second semi-cylindrical member and a leaf spring for radially inwardly urging opposed edge sides of the notch in the covering member.

17. A shuttle hook driver according to claim 12, wherein the connecting member includes a first semi-cylindrical member secured to the drive shaft of the stepping motor and a second semi-cylindrical member secured to the hook shaft and disposed opposite to the first semi-cylindrical member, and the torque damping mechanism includes a buffing member interposed between portions of the first and second semi-cylindrical members opposed to each other and a covering member covering outer circumferential faces of the first and second semi-cylindrical members in contact with said face of either one of the first and second semi-cylindrical members, an arc-shaped leaf spring disposed along the outer circumference of the covering member and having opposed ends extending to the other of the first and second semi-cylindrical members, and a pair of friction-inducing members disposed at both ends of the arc-shaped leaf spring so as to be urged by the leaf spring to abut the outer circumferential face of the other of the first and second semi-cylindrical members.

18. A shuttle hook driver for a sewing machine comprising:

a stepping motor for driving a shuttle hook capturing a thread loop in cooperation with a sewing needle, the stepping motor including a drive shaft, the shuttle hook including a hook shaft;

an elastic member provided on a connecting member connecting between an end of the drive shaft of the stepping motor and an end of the shuttle hook so as to transmit a driving force of the drive shaft to the shuttle hook and so as to serve as a buffer; and a rotary oil damper mounted on the drive shaft of the stepping motor.

19. A shuttle hook driver according to claim 18, wherein the elastic member is made of a hard rubber.

20. A shuttle hook driver according to claim 18, wherein the rotary oil damper is mounted on a side of the drive shaft opposite a side thereof on which the connecting member is provided.

* * * * *